US008888540B2

(12) United States Patent
Hoffmeister

(10) Patent No.: US 8,888,540 B2
(45) Date of Patent: Nov. 18, 2014

(54) POWER-TRACK COUPLING

(71) Applicant: Oliver Hoffmeister, Luedenscheid (DE)

(72) Inventor: Oliver Hoffmeister, Luedenscheid (DE)

(73) Assignee: Hoffmeister Leuchten GmbH, Schalksmuehle (DE)

( * ) Notice: Subject to any disclaimer, the term of this patent is extended or adjusted under 35 U.S.C. 154(b) by 8 days.

(21) Appl. No.: 13/859,237

(22) Filed: Apr. 9, 2013

(65) Prior Publication Data

US 2013/0273757 A1 Oct. 17, 2013

(30) Foreign Application Priority Data

Apr. 11, 2012 (DE) ..... 10 2012 007 086

(51) Int. Cl.
*H01R 9/22* (2006.01)
*H01R 25/14* (2006.01)
*H01R 25/16* (2006.01)

(52) U.S. Cl.
CPC ..... *H01R 25/16* (2013.01); *H01R 25/142* (2013.01); *H01R 25/145* (2013.01)
USPC ..... 439/715

(58) Field of Classification Search
CPC ..... H01R 9/26; H01R 25/14
USPC ..... 439/715, 716, 709, 922, 111
See application file for complete search history.

(56) References Cited

U.S. PATENT DOCUMENTS

| | | | | |
|---|---|---|---|---|
| 5,629,831 | A * | 5/1997 | Eggert et al. | 361/624 |
| 6,452,785 | B1 * | 9/2002 | Kaaden et al. | 361/622 |
| 7,168,977 | B2 * | 1/2007 | Reibke et al. | 439/507 |
| 7,192,316 | B1 * | 3/2007 | Pollmann | 439/716 |
| 7,690,952 | B2 * | 4/2010 | Koellmann et al. | 439/716 |

FOREIGN PATENT DOCUMENTS

DE 2250738 A 4/1974

* cited by examiner

*Primary Examiner* — Phuongchi T Nguyen
(74) *Attorney, Agent, or Firm* — Andrew Wilford

(57) ABSTRACT

A coupling is used with a U-section longitudinally extending power track having a floor and a pair of side walls defining a longitudinally and transversely open retaining channel and provided on the side walls with respective dielectric support rails each carrying a respective longitudinally extending main conductor transversely exposed in the slot and connected to phase or ground. The coupling has a dielectric coupling housing extending along an axis and having center structure defining a center symmetry plane perpendicular to the axis and end formations projecting axially oppositely from the center structure and each fittable longitudinally into the channel at an end of the power track to an insertion depth determined by the center structure. Two L-section and longitudinally extending metallic contact strips are carried on and transversely limitedly movable in a predetermined transverse direction in the dielectric housing.

9 Claims, 9 Drawing Sheets

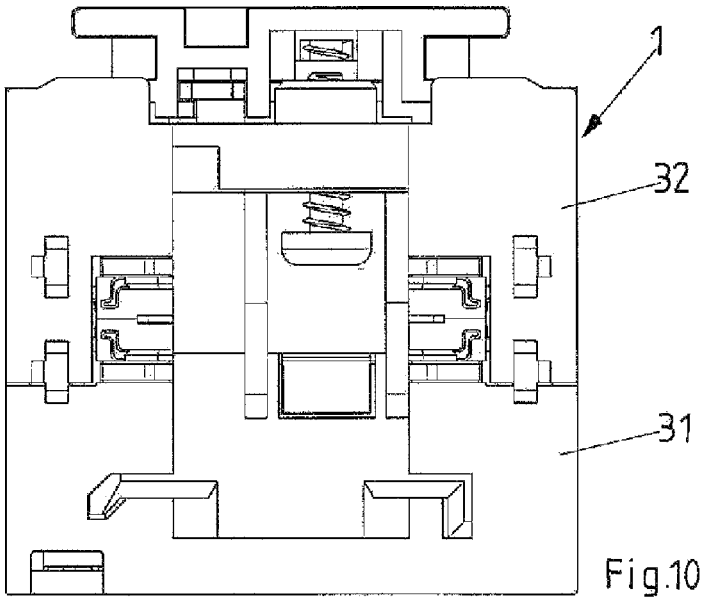
Fig.10
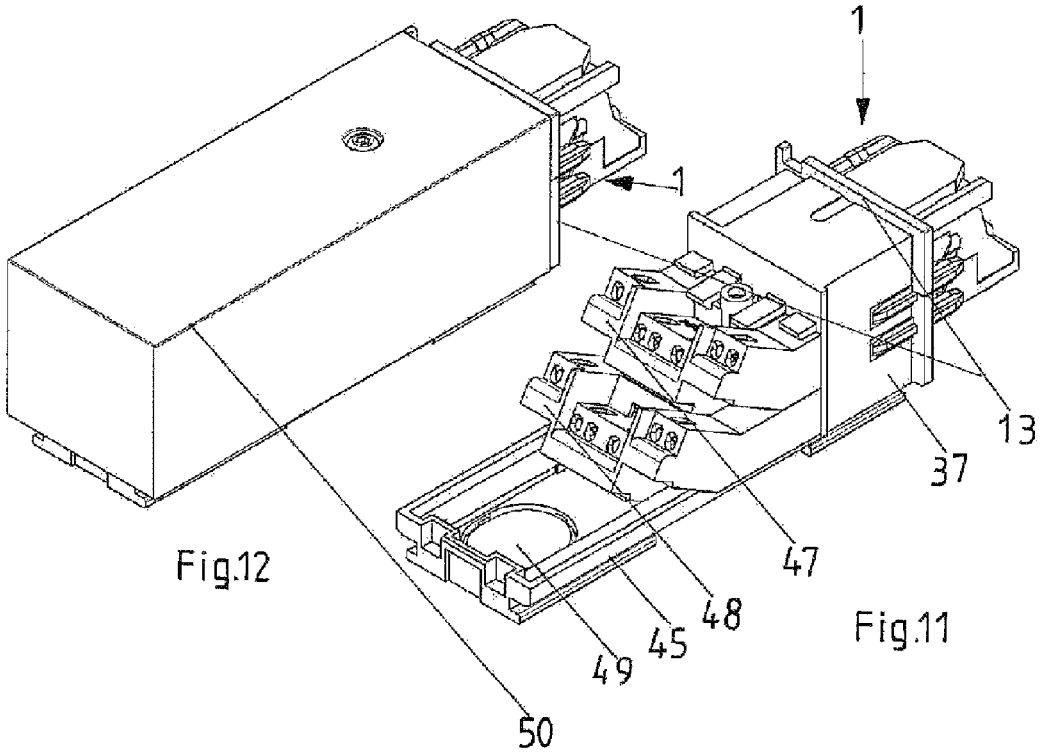
Fig.12
Fig.11

POWER-TRACK COUPLING

FIELD OF THE INVENTION

The present invention relates to a power-track coupling. More particularly this invention concerns such a coupling used with a multiphase power track.

BACKGROUND OF THE INVENTION

A metal U-section power track has parallel side walls that laterally delimit a retaining channel and that carry respective dielectric support rails that each in turn carry a plurality of uninsulated, bare electrical conductors that are insulated from one another, parallel to one another in the rail longitudinal direction, opposite one another, and exposed in the retaining channel. A ground conductor is also exposed in the retaining channel, preferably on the floor of the power track.

A coupling for joining two such rails or for joining such a rail to a power source is typically formed essentially symmetrically with respect to a center transverse plane and has contacts for contacting the conductors of the power track and mechanical guide and stop elements with which the coupling may be inserted, with its insertion depth limited, into the end of a power track.

Power tracks of this type are known for instance from FIG. 3 of DE OS 22 50 738. These couplings can connect such power tracks to one another mechanically and electrically, the power tracks being placed for example coaxially with one another on a suitable surface. In conventional couplings, relatively complex resilient contacts are provided that also lead to wear of the plastic parts when cooperating with the insulating parts of the housing element surrounding the contacts, so that service life is limited.

OBJECTS OF THE INVENTION

It is therefore an object of the present invention to provide an improved power-track coupling.

Another object is the provision of such an improved power-track coupling that overcomes the above-given disadvantages, in particular that is cost-effective to produce and simple to assemble, while in addition wear in the area of the resilient contacts should be minimized.

SUMMARY OF THE INVENTION

A coupling is used with a U-section longitudinally extending power track having a floor and a pair of side walls defining a longitudinally and transversely open retaining channel and provided on the side walls with respective dielectric support rails each carrying a respective longitudinally extending main conductor transversely exposed in the slot and connected to phase or ground. The coupling has according to the invention a dielectric coupling housing extending along an axis and having center structure defining a center plane perpendicular to the axis and end formations projecting axially oppositely from the center structure and each fittable longitudinally into the channel at an end of the power track to an insertion depth determined by the center structure. The housing is substantially symmetrical to the center plane. Two L-section and longitudinally extending metallic contact strips are carried on and transversely limitedly movable in a predetermined transverse direction in the dielectric housing. The contact strips each have two L-legs of which one extends in the predetermined transverse direction and forms a pair of transversely projecting contacts longitudinally symmetrically flanking the center structure. The other L-leg of each contact strip extends substantially perpendicular to the predetermined transverse direction and is juxtaposed with a respective guide face of the housing. Respective L-section sheet-metal guide elements fitted with the contact strips each have one flat L-leg lying between the other L-leg of the respective contact strip and the respective guide face and another L-leg formed as a V-shaped spring having a pair of ends longitudinally symmetrically flanking the center plane, bearing in the predetermined transverse direction on the respective other L-leg, and biasing the respective contact strip and its contacts transversely outward.

With this configuration a wear-reducing arrangement of the contacts and a simple structure are permitted because the edge of the second L-leg of the L-section strips is not positioned directly against the contact face of the housing, but rather there is an intermediate layer made of a flat sheet-metal strip that is a component of a sheet-metal spring that, in addition to this sheet-metal strip has a V-shaped spring unitarily formed therewith that acts on the first L-leg of the L-section strip and provides adequate contact pressure. This structure is cost effective and simple to manufacture because in principle the essential components comprise only the L-section contact strip and the L-section spring-metal strip.

In order to attain a cost-effective structure for the coupling, it is further proposed that the coupling housing has an approximately U-shaped first basic body element and a second basic body element that completes it to form a closed unit, the first basic body element receiving two first pairs of L-section strips, including sheet-metal strips made of spring sheet metal, that are separated from one another by insulating bars, a first dielectric intermediate wall being provided, and the second basic body element receiving two second pairs of L-section strips, including sheet-metal strips made of spring sheet metal, separated from one another by insulating bars. Both basic body elements are joined to one another when fitted together with a snap fit.

In accordance with this structure, the coupling comprises simple individual parts that permit the couplings to be assembled rapidly and easily.

Conventional power track systems generally work with a system in which three phase conductors, one neutral conductor, and one ground conductor are provided in the track and must be contacted with the coupling element. The coupling described may be used with such a design. If the power tracks are of a new type of construction in which not only are three phase conductors and one neutral conductor provided, but also two other conductors suitable for conducting current are added to the power track, it is a simple matter to make the coupling for this.

To this end the invention proposes that between the first and second pairs of contact strips are mounted two third pairs of contact strips and a second dielectric intermediate wall so that the third pair of contact strips is mounted insulated from one another and with respect to the first and second pairs. The third pairs of contact strips also each form two resilient contact formations that project beyond the housing side wall.

In accordance with this embodiment it is merely necessary to also provide the second dielectric intermediate wall and the two third pairs of contact strips. In this manner the coupling may then be used with the above-described new power track.

In order to make the ground conductor contact on the coupling in a simple manner, as well, a ground conductor contact having two projecting, resilient contact tabs is fixed to a head side of the dielectric housing.

The object underlying the invention is further to make with such a coupling a modular system in which it is possible with a limited number of individual components to produce the greatest possible number of power track accessory pieces, for instance power supply elements, corner connectors, cross connectors, and the like.

In order to make such a solution proceeding from a coupling as described above, the coupling on the first side of the center transverse plane act as plug-in power track connector and that parts on the second side of the center plane form a power supply part in that a complementarily shaped insulating element may be or is placed thereon and accommodates electrical conductors made of sheet-metal running in guide tracks parallel to the plug-in direction for the coupling. The ends of the conductors or contact elements in the insulating element are contacted with the contact strips of the coupling and the free ends of which project out of the insulating element and, preferably rectified, are angled way from a plate that is attached or affixed to the insulating element and that forms the assembly surface with cable inlet, so that they form an acute angle with the plate. These free ends each have a contact piece that comprises a spring connector contact with at least one plug-in area or preferably two separately resilient plug-in areas, and in that the free ends projecting out of the insulating element, including spring connector contacts, are surrounded by channel-like insulating parts that are attached, especially locked, to the insulating element and have insertion openings for electrical conductors on the end in the area of each spring connector contact.

In accordance with this embodiment, which is itself considered inventive, the field of use for the coupling is significantly expanded. For one thing, so that the coupling can only be inserted, for instance into a power track, up to this partition, such a coupling that has an exterior partition in the center transverse plane may have a corresponding plug-in connector area with contacts and the like on both sides of this partition.

In order to also be able to use such a coupling for instance as a power supply element or even for connectors, the end of the coupling that is not inserted into the power track is provided with a matching contoured insulating element that is placed, correctly positioned, onto the end of the coupling. This insulating element thus has a shape that matches that of the coupling. The insulating element has a plurality of guide tracks for electrical conductors. Electrical contact strips or conductors made of sheet-metal, for instance press-bent parts, are inserted into these guide tracks so that these inserted ends are contacted with the corresponding contacts for the coupling. The free ends of these electrical conductors project out of the insulating element. A plate that practically forms the assembly plane of the insulating element or the coupling on one surface or is disposed therein is attached to the insulating element. This plate is attached to the insulating element, for instance it is affixed or joined thereto in some other manner. In addition, the free ends of the contacts that project out of the insulating element are angled away from the assembly plane that is formed by the plate, for instance such that with the plate they form an acute angle of approximately 30°. Moreover, the ends of the contacts have contact pieces in the form of sleeves that have a push-in spring connector contact with two separately resilient insertion areas for two connector conductors. Overall these projecting ends of the contacts, including the spring connector contacts, are surrounded by channel-like insulating parts that electrically insulate and also mechanically stabilize them, it being possible to attach these channel-like insulating parts to the insulating element, for instance by locking them together.

Not only does this embodiment permit a simple modular structure for the power supply part formed in this manner, but also due to the arrangement and orientation of the spring connector contacts it is much easier for the installer to insert conductor leads into the spring connector contacts and to get a good connection. The double contacts are especially useful because a plurality of connector conductors may be attached, which is especially necessary when looping through, that is, when two leads must be connected to each spring connector contact. Due to the angled design, it is much easier to guide the cable leads to the spring connector contacts. The number of electrical conductors, including spring connector contacts, should generally equal the number of conductors necessary for the matching power track. Thus for instance in a power track with three phase connectors, one neutral conductor connector, and a ground conductor connector, at least five such electrical conductors, including contact pieces, are necessary. If, as the invention also provides, the power track has two other conductors for supplying current, the number of conductors and contact pieces increases by two. Moreover, for reasons of symmetry the ground conductor contacts may mounted in a set of two so that they permit the appropriate arrangement, depending on application purpose.

In principle, the insulating element may be used for all applications, but if the ground conductor connector in the floor of the bar is provided asymmetrically, that is, eccentrically, an insulating element is provided that is suitable for the embodiment of the ground conductor on the left side of the floor, and an alternative insulating element is provided that provides for the ground conductor to be mounted eccentrically on the right side of the floor of the power track. All of the other components are the same for all embodiments.

In addition the channel-like insulating parts are additionally or alternatively attached to the plate, especially mechanically latched.

For instance, the channel-like insulating parts may be mechanically latched or locked to the plate.

In order to permit for instance in a cover outlet for a connector cable a covered arrangement of this connection area and to permit the cable to be guided to the connector contacts for the power supply or the like, the plate has as a cable-insertion hole in an area facing away from the insulating element and projecting over the channel-like insulating parts.

For assembly, the plate is fitted with this opening over the cable outlet so that the leads exiting from the cable may then be inserted into and connected to the appropriate spring connector contacts.

Such an embodiment may be used for a power supply element in which only the leads of the connection cable are inserted into the spring connector contacts and the entire unit is then inserted into the end of the power track.

Alternatively and additionally, however, it is also possible for a plurality of couplings to be provided with an insulating element, electrical conductors, spring connector contacts, and insulating parts that are oriented opposing one another, in an L shape, in a T shape, or in a star shape, mounted on or fixed to corresponding straight, L-shaped, T-shaped, or star-shaped plates, the plates having the opening in the center or in the area of intersection as a cable insertion point.

In this arrangement, a matching number of corresponding components is provided, only the plate on which some of the components are mounted or which is attached to the insulating element being formed differently, wherein it may be formed in an L shape, in a T shape, or in a star shape, depending on the application purpose.

Finally, the invention provides that a housing cover is provided that may be fitted over the insulating element or elements, including electrical conductors, spring connector contacts, insulating parts, and plate with opening, and may be fixed to parts covered thereby.

The entire assembled unit of insulating element contacts and plate may be covered by such a housing cover so that an arrangement is attained that is quite safe from being touched. The housing cover is formed according to this shape, whether L-shaped, T-shaped, or star-shaped, and may be placed onto this assembled unit and connected to the lower part.

BRIEF DESCRIPTION OF THE DRAWING

The above and other objects, features, and advantages will become more readily apparent from the following description, reference being made to the accompanying drawing in which:

FIG. 10 is an end view of the coupling;

FIG. 11 shows a coupling with its cover removed and to which a power feed adapter has been added, all seen in perspective from above;

FIG. 12 is the same view as FIG. 11 but with a cover in place;

DETAILED DESCRIPTION OF THE INVENTION

Figure 1:
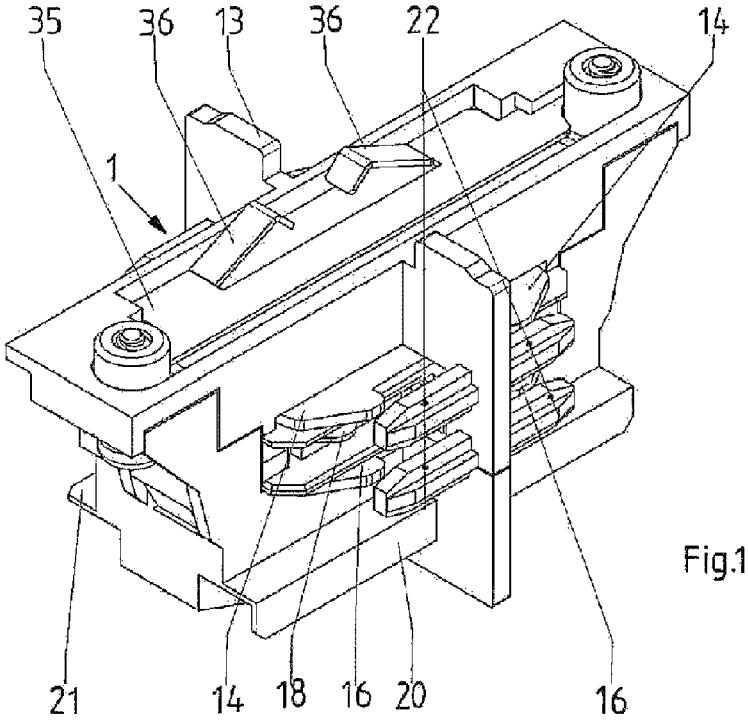
FIG. 1 is a coupling according to the invention seen diagonally from above.
Figure 2:
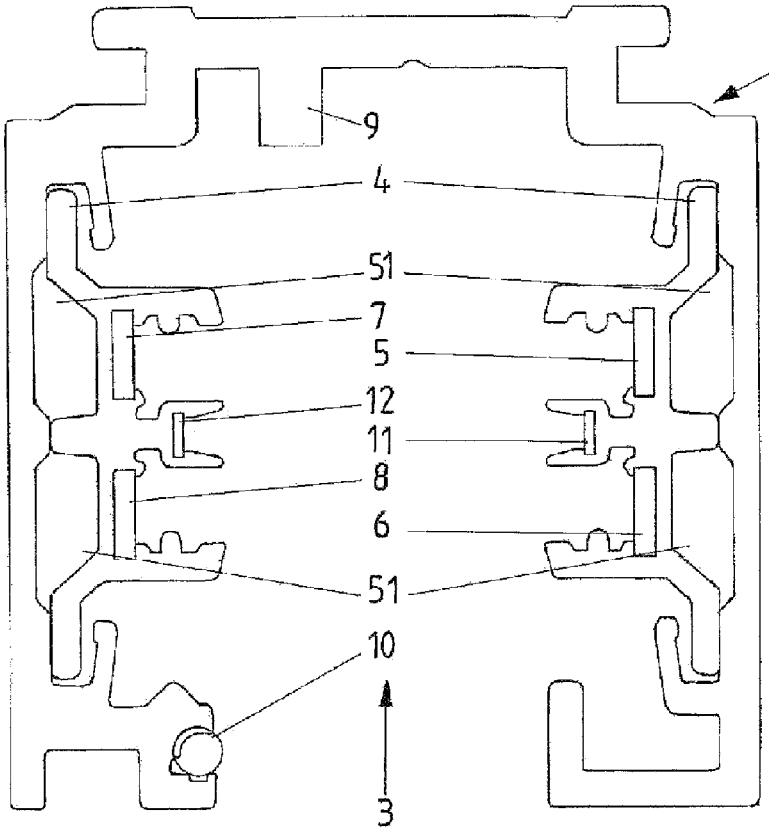
FIG. 2 is an end view of a power track that fits the coupling in FIG. 1.

As seen in FIG. 2 a metal power track 2 is basically of U-section and has side walls that define a retaining channel 3 and that carry respective dielectric support rails 4 that each receive a plurality of uninsulated, bare electrical outer conductors 5, 6, 7, 8 that are insulated from one another, parallel to one another in the rail longitudinal direction, opposite one another, and exposed in the retaining channel 3. Three of the outer conductors are phase conductors and one is a neutral conductor. In addition, a ground conductor 9 that is also exposed in the retaining channel 3 is provided on the floor of the power track 2, and a further ground conductor 10 is also provided on one side wall of the power track 2. Moreover, mounted between each conductor pair 5 and 6 or 7 and 8 is a fifth and a sixth inner conductor 11, 12 that are insulated from the other conductors of the respective pair of conductors 5, 6, or 7, 8 on the respective side wall. These inner conductors 11 and 12 are also exposed in the retaining channel 3. The inner conductors 11 and 12 may act as control conductors for an electrical or electronic control or as additional power conductors for other electrical consumers.

A corresponding coupling 1 that has an end subdivided by a partition 13 may be inserted into the end of such a power track 2 is shown in FIGS. 1 and 3-10. This coupling 1 is formed symmetrically with respect to a center transverse plane defined by a partition 13. It has contacts 14, 15, 16, 17, 18, 19 for contacting the conductors 5 through 8, 11, and 12 of the power track 2. Moreover, the coupling 1 has mechanical guide elements 20, 21 and guide insulating pins 22 so that the coupling 1 may be inserted, with its insertion depth limited, into the end of the power track 2. The partition 13 limits the insertion depth. Insulating pins 22 engage in corresponding cavities 51 in the power track 2 that are formed between the side walls of the power track 2 and the dielectric support rails 4.

The contacts 14 through 19 are each resiliently mounted movable in a housing element of the coupling 1 transverse to the housing longitudinal axis, that is, essentially parallel to the partition 13. The contacts 14, 15, 16, 17 are each L-section strips 23 that when assembled as shown for instance in FIG. 1, form on a first L-leg one laterally projecting contact formation 24 on one side and one laterally projecting contact formation 24 on the other side of the center housing stop wall or partition 13 that forms the center transverse plane, and that are positioned with an edge 26 of the second L-leg 27 indirectly against a dielectric wall for the housing of the coupling 1, with a flat sheet-metal strip 28 therebetween.

The center element 30 of a slightly V-shaped bent spring 29 is unitarily formed with this flat sheet-metal strip 28 of spring sheet metal and projects from and is positioned at a right angle to the sheet-metal strip 28. The L-leg ends of the spring 29 bear resiliently against the outer surface of the second L-leg 27 of the L-section strip 23 that faces away from the projecting contact formations 24 of the first L-leg 25. What this achieves is that the edge 26 does not engage directly against plastic parts, but rather against the flat sheet-metal strip 28, so that movement-induced wear between the L-section strips 23 and the plastic part is avoided.

Figure 3:
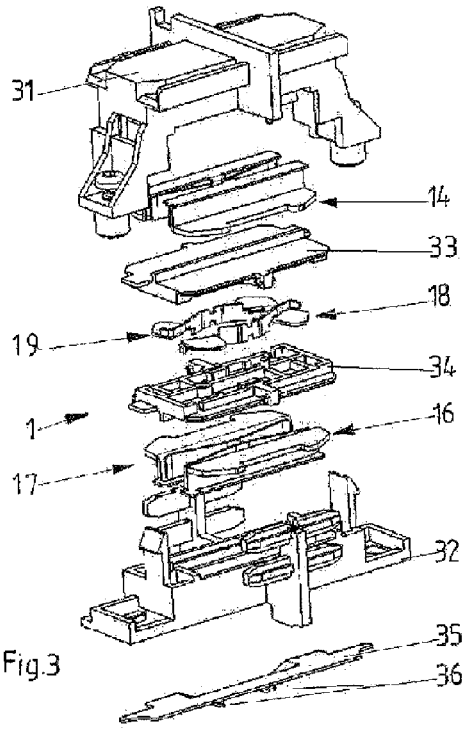
FIG. 3 is an exploded view of the coupling.
Figure 4:
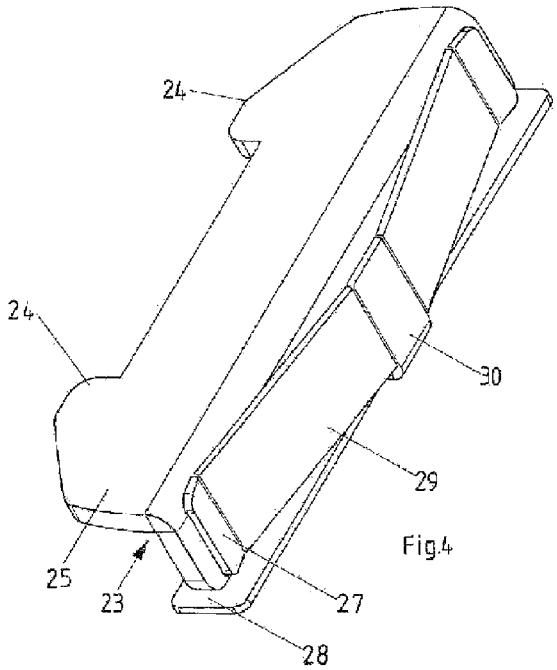
FIG. 4 is an enlarged view of a detail from FIG. 3.
Figure 5:
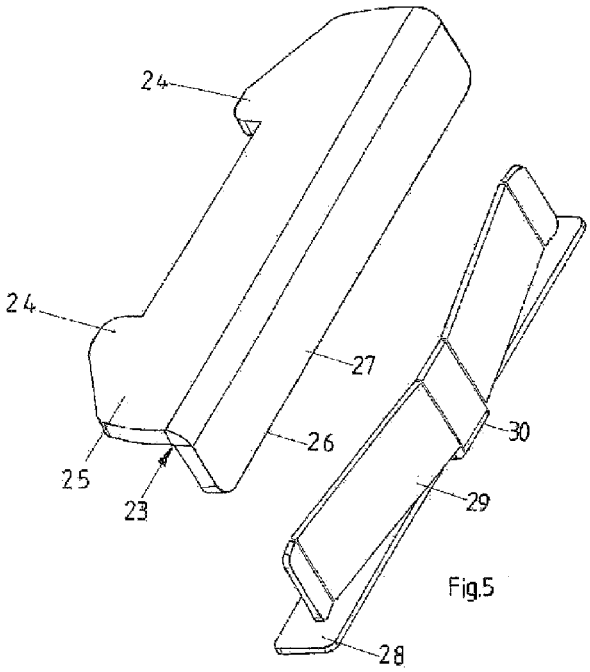
FIG. 5 is an exploded view of the detail.
Figure 6:
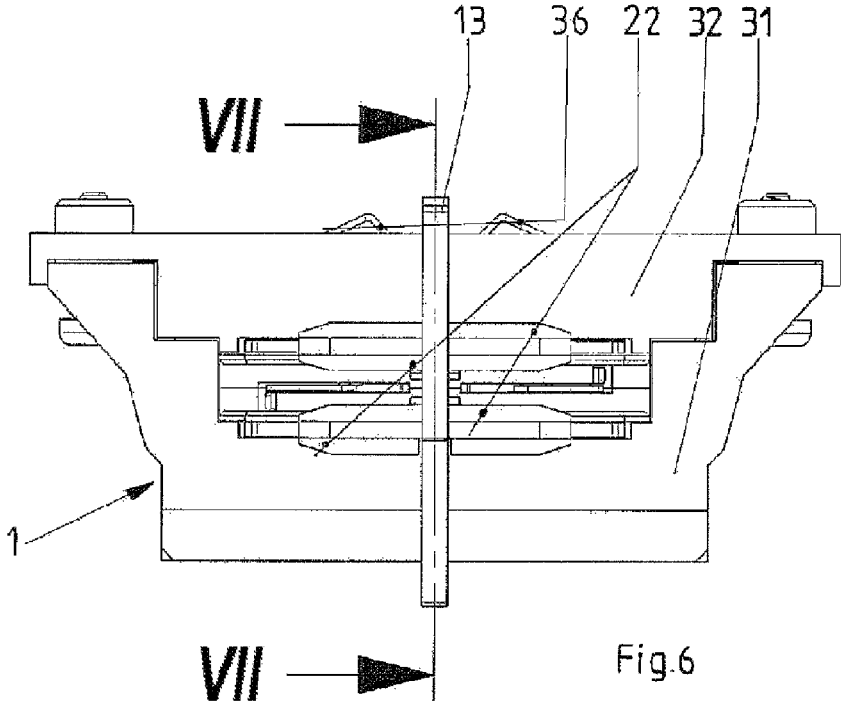
FIG. 6 is a side elevation view of the coupling.
Figure 7:
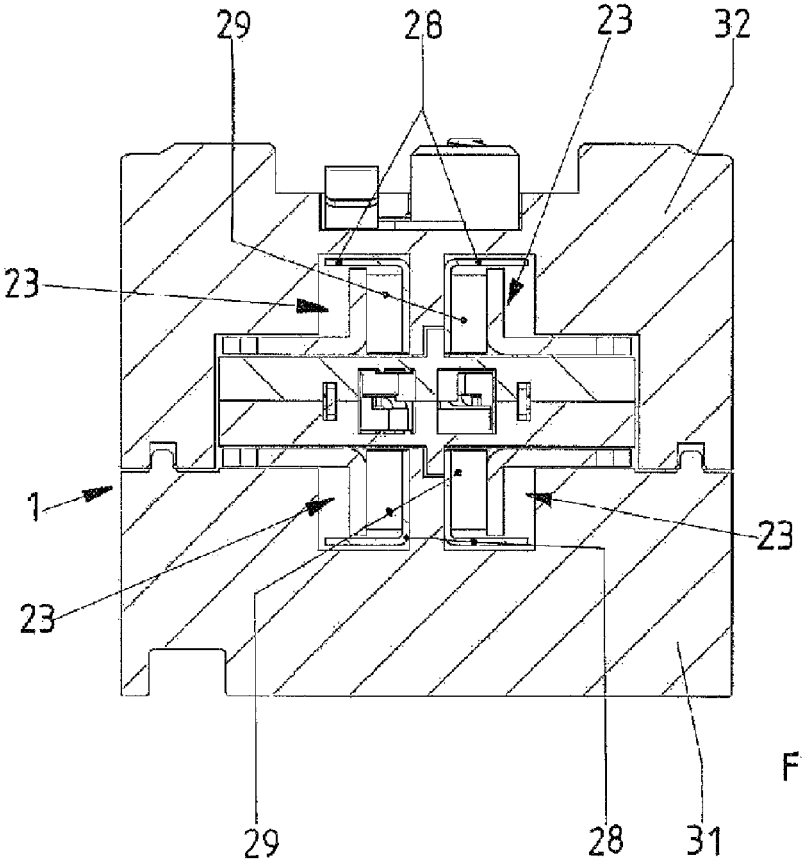
FIG. 7 is a section taken along line VII-VII of FIG. 6.
Figure 8:
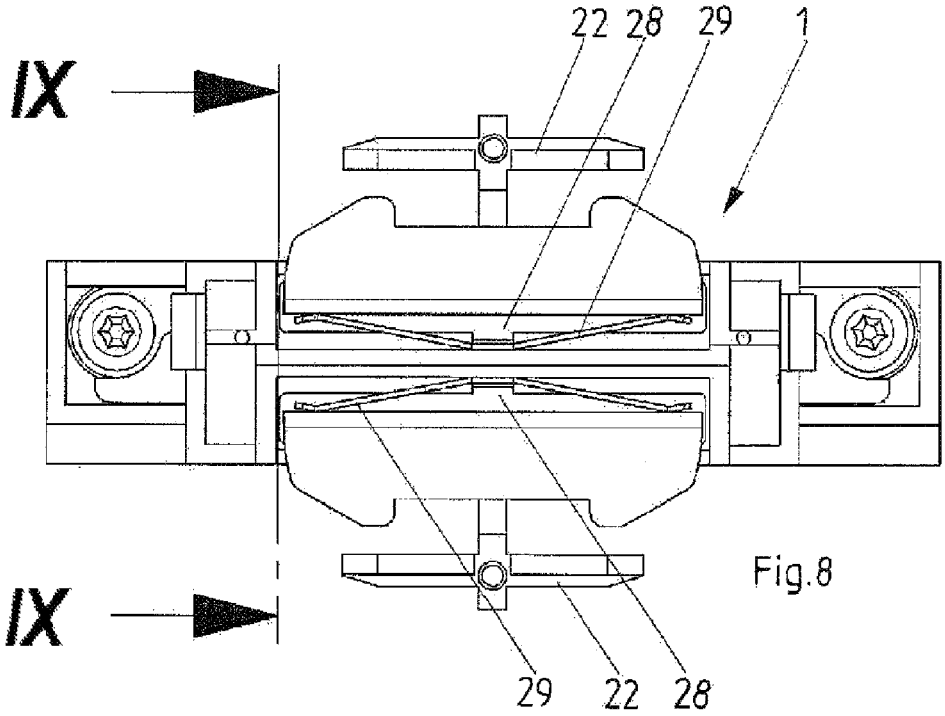
FIG. 8 is a top view of a detail of the coupling.
Figure 9:
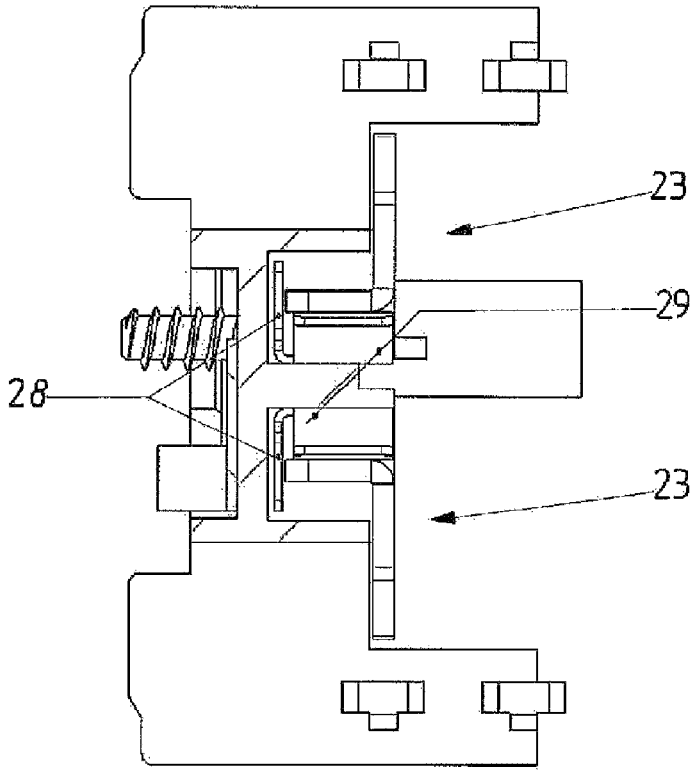
FIG. 9 is a section taken along line B-B of FIG. 8.
Figure 13:
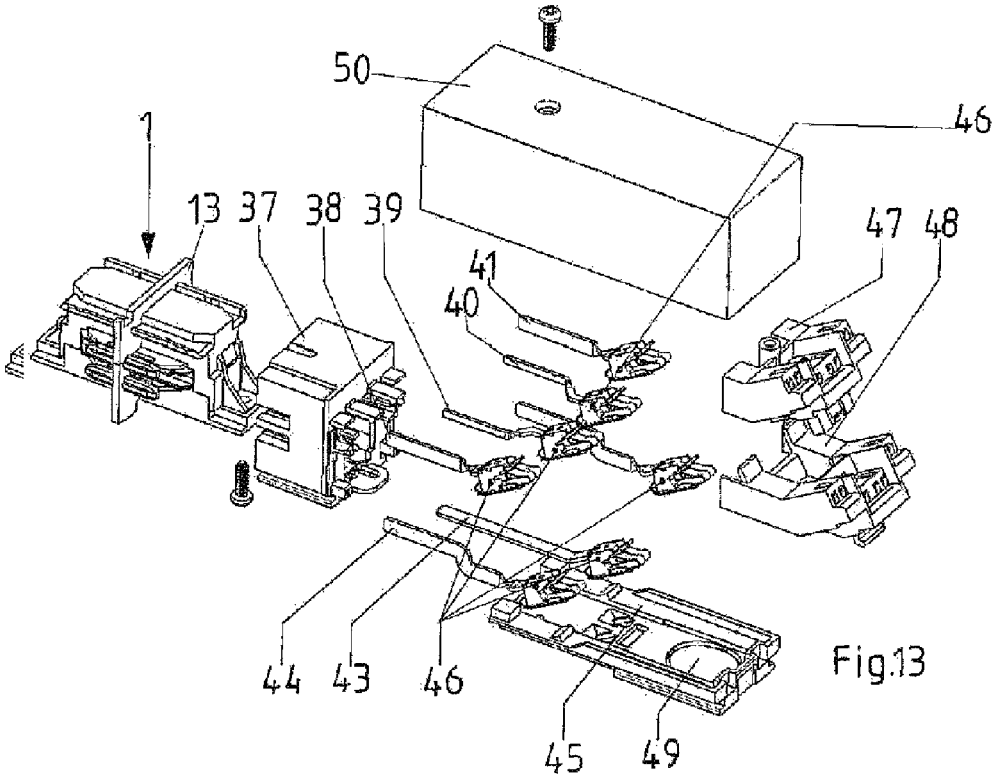
FIG. 13 is an exploded drawing of the coupling and adapter as shown in FIG. 11.
Figure 14:
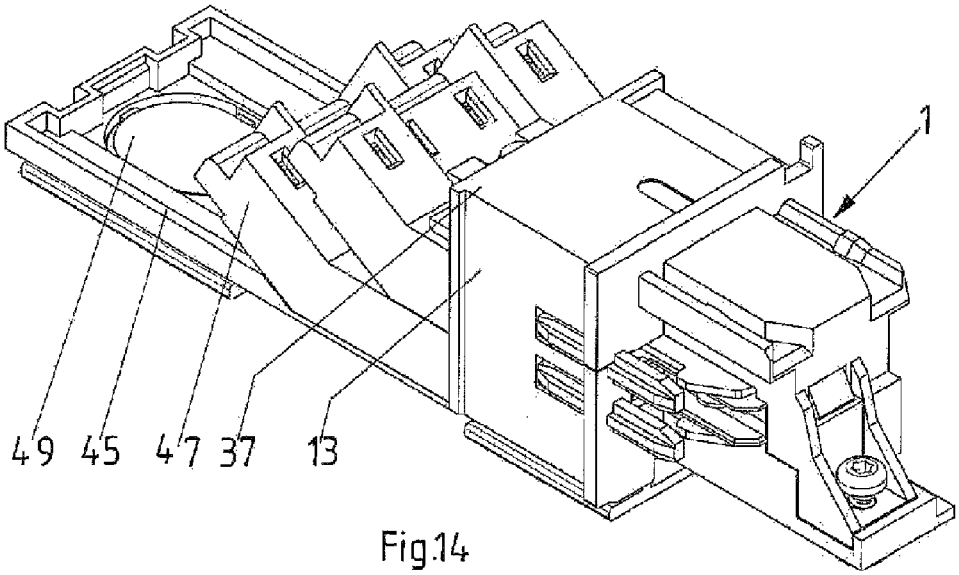
FIG. 14 is the FIG. 11 coupling and connector in its final assembled position in perspective view from above, but with no cover.

As may be seen in particular from FIG. 3, the coupling 1 has a dielectric housing with an approximately U-shaped first basic body element 31 and a second basic body element 32 that completes it to form a closed unit. The first basic body element 31 receives two first pairs of the L-section strips 23, including the sheet-metal strips 28, that are separated from one another by insulating bars. These form the contacts 14 and 15. Then a first dielectric intermediate wall 33 is provided. The second basic body element 32 may receive two second pairs of L-section strips 23, including sheet-metal strips 28 that are separated from one another by insulating bars and that correspond to the contacts 16 and 17. The two basic body elements 31, 32 are joined to one another when fitted together with a snap fit. In the illustrated embodiment, the first and second pairs of contact strips 23 that form the contacts 14, 15 and 16, 17 flank respective third pairs of contact strips that form the contacts 18 and 19, and a second dielectric intermediate wall 34. Thus these contact strips are also electrically insulated from the other contacts 14, 15 and 16, 17 and also from one another by corresponding bars of the intermediate walls 33 and/or 34. As may be seen for instance in FIG. 3, each of the third pair of contact strips that form the contacts 18 and 19 also has two laterally projecting resilient contact formations that when fitted together project outward beyond the housing side wall of the coupling 1.

Finally, a ground conductor contact 35 that has two resilient contact tabs 36 that project downward in FIG. 3 is fixed to a head side of the dielectric housing, especially of the second basic body element 32.

The coupling 1 is of modular construction and comprises relatively simple molded plastic parts and sheet-metal parts, and may or may not be equipped with the contacts 18, 19, depending on application.

Such a coupling may be used as a single component in order, for instance, to connect two power tracks to one another. But such a coupling may also especially be used as a component of other accessory parts, as shall be explained in the following.

FIGS. 11 through 14 show by way of an example a design in which a coupling 1 has only the parts to one side of the partition plane of the partition 13, which parts act as the coupling for a plug-in power track connector. The other side of the coupling 1 on the opposite the partition 13, is formed as a power-supply connector. To this end an insulating element 37 may be or is placed over the one plug-in area of the coupling 1. This insulating element 37 holds electrical conductors 38 through 44 that are formed as punched sheet-metal parts and run parallel to the plug-in direction for the coupling 1 in corresponding guide tracks. At their one end these electrical conductors are inserted into the corresponding channels of the insulating element 37, and when thus inserted into the coupling 1 they are conductively connected to the corresponding contacts of the coupling 1. The insulating element 37 maintains the fixed mechanical contact with the coupling 1 when it is plugged in.

The free ends of the electrical conductors 38 through 44 project out of the insulating element 37 on the side facing away from the coupling 1, and are parallel to each other. They are all oriented at an acute angle facing away from a plate 45 attached to the insulating element. Each of the free ends of the electrical conductors 38 through 44 have a contact piece 46 that comprises a spring connector contact with two plug-in areas for two conductors to be plugged in, the two plug-in areas being formed separately and resilient. These details may be seen in particular in FIG. 13. When fitted together these free ends, including spring connector contacts 46 projecting out of the insulating element 37 are surrounded by channel-like dielectric sockets 47, 48 that are placed over these free ends and locked to the insulating element 37 or one another and/or are mechanically latched or locked to the plate 35. In the area behind which the corresponding contact pieces 46 are provided each of these dielectric sockets 47, 48 has two insertion openings for two conductors for each contact piece 46.

This embodiment is particularly advantageous because the connector end that is to be connected by corresponding conductors to the contact pieces 46, does not have to be executed horizontally in a plane that approximates that of the plate 45, but rather because of the angling and the different spacing of the contact pieces 46 the conductors may be easily guided to the insertion openings for the dielectric sockets 47, 48 and thus to the contact pieces 46. Assembly is therefore substantially simplified an can be done without using tools.

The round openings on the ends of the parts 47, 48 are for inserting conductor leads. The rectangular openings on the top side of the parts 47, 48 permit the installation to be checked using a voltage detector or the like. Moreover, with a tool, for instance the blade of a screwdriver, they facilitate releasing the individual conductors in the gripper-type contact pieces 46.

One additional special characteristic is that the plate 45 has an opening 49 in an area that faces away from the insulating element 37 and projects over the channel-like dielectric sockets 47, 48. During assembly the plate may be mounted over for instance a wall box so that the cable can exit through the opening 49 and the leads of the cables can be guided to the contact pieces 46 and contacted. After assembly and after the leads have been connected to the contact pieces 46, an additional housing cover 50 may be fitted thereover and mounted, it being possible to fasten the cover in a suitable manner, for instance with a screw, to the dielectric parts. In the illustrated embodiment, to this end the insulating part 47 is provided with a corresponding screw boss into which the screw shown at the top of the drawing may be screwed.

Figure 15:
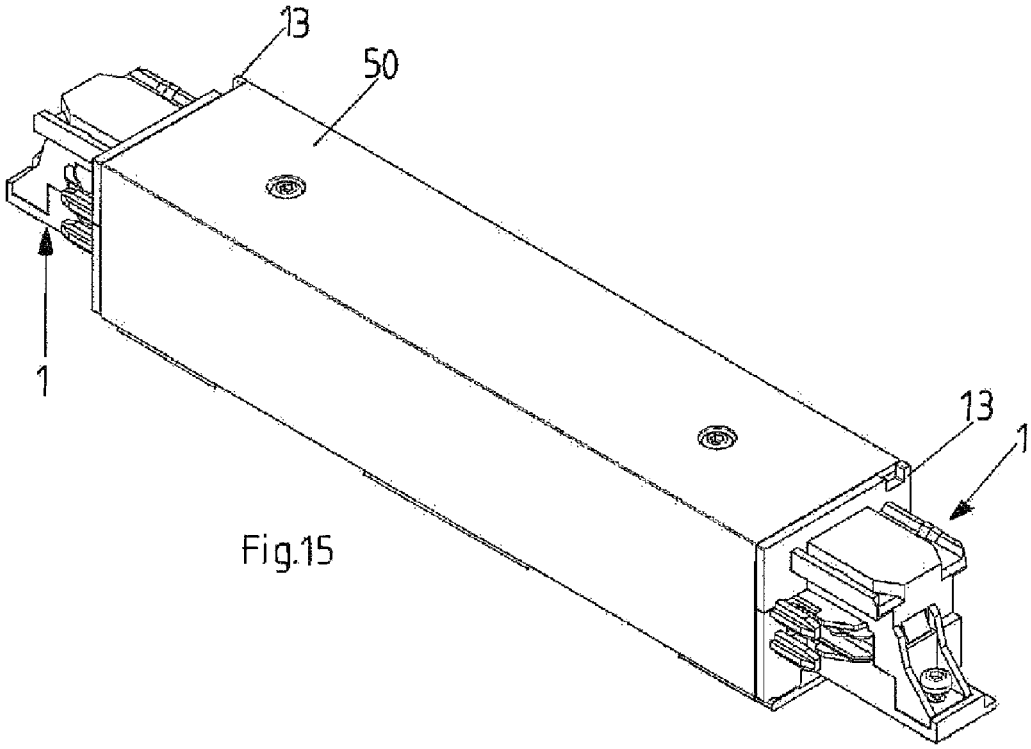
FIG. 15 is a view of a variant of the coupling.
Figure 16:
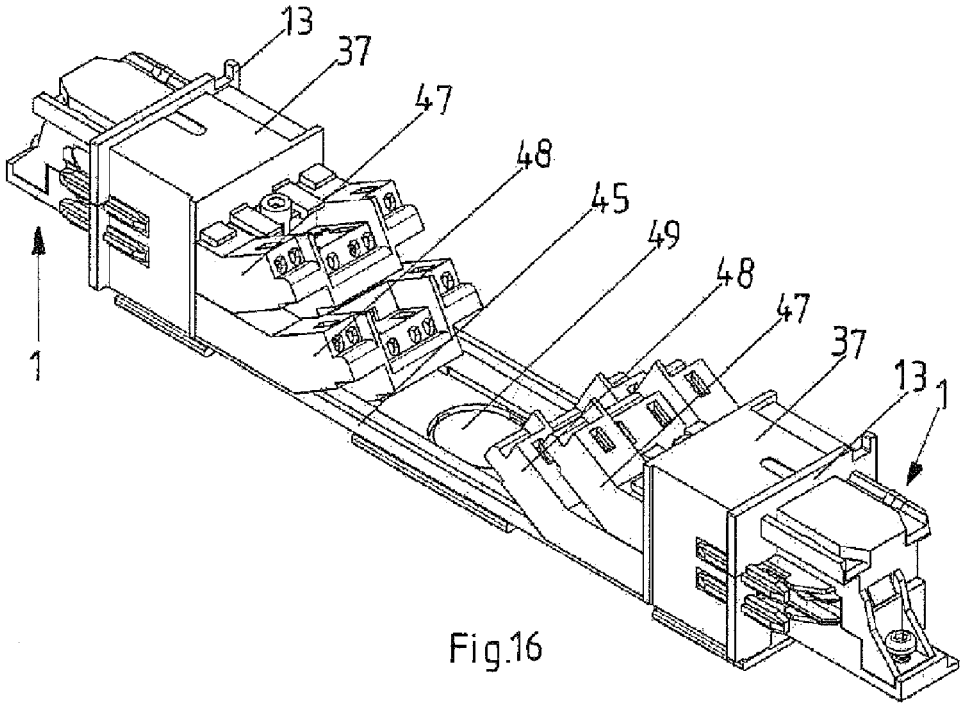
FIG. 16 shows the variant without its cover.
Figure 17:
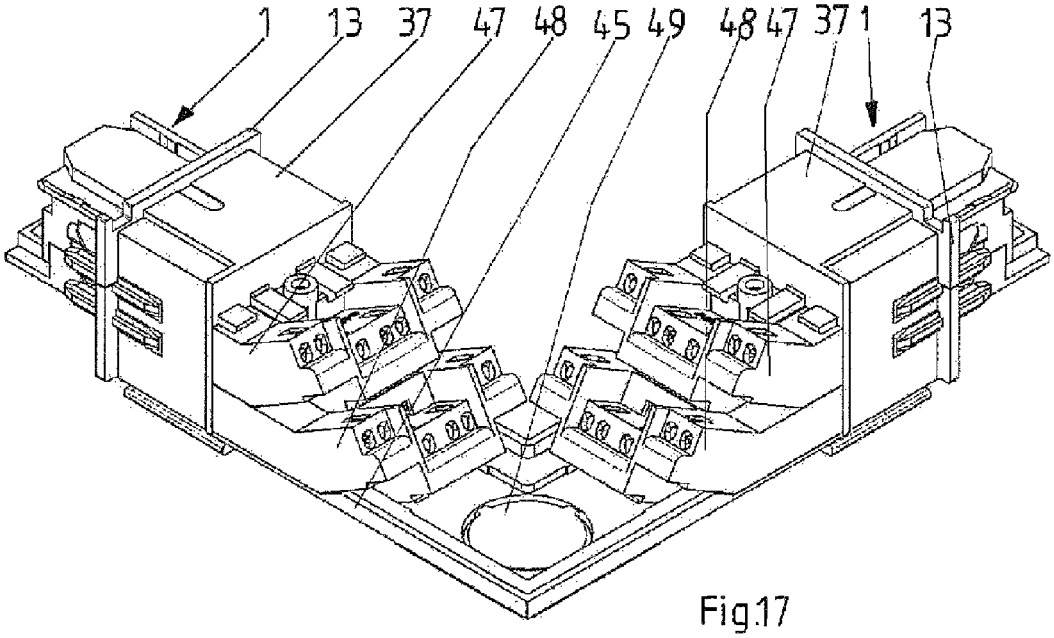
FIG. 17 is a view of another variant as in FIG. 16.

The various uses for the components using one and the same coupling 1 is significant, since not only is it possible to supply power as in FIGS. 11 through 14 in combination with the coupling 1, but it is also possible to provide a direct connection of two couplings 1 with a power supply disposed therebetween, as illustrated in FIGS. 15 and 16. Moreover, an L-shaped connection of power tracks may be effected with one device, in this case the power being supplied either through a cable guided through the opening 49 and/or by the through-connection of the one coupling 1 to the other coupling 1 via suitable contact bridges. Such contact bridges may be preassembled assemblies in this case and also in other embodiments in order to minimize assembly at the end user location.

Figure 18:
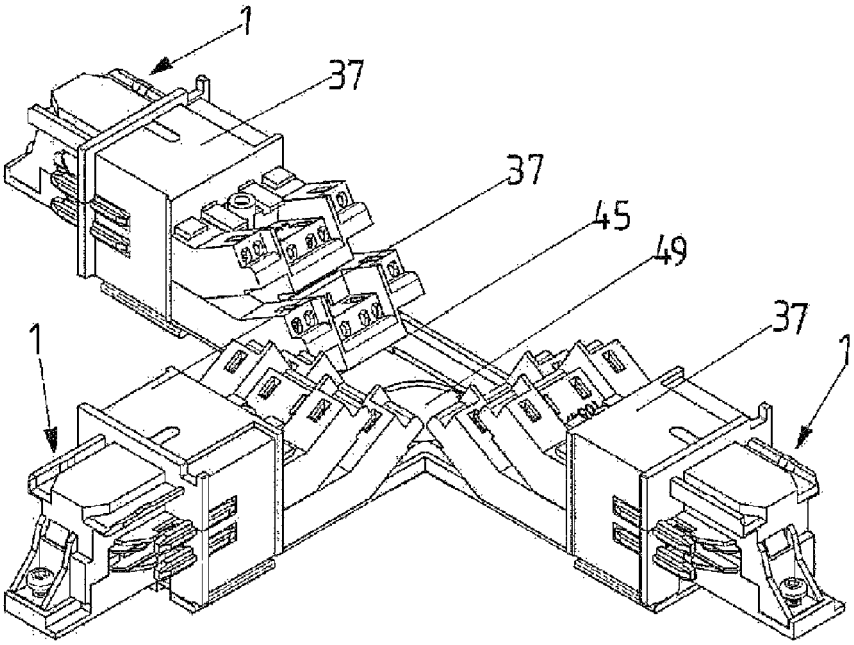
FIG. 18 is a view of another variant as in FIG. 16.
Figure 19:
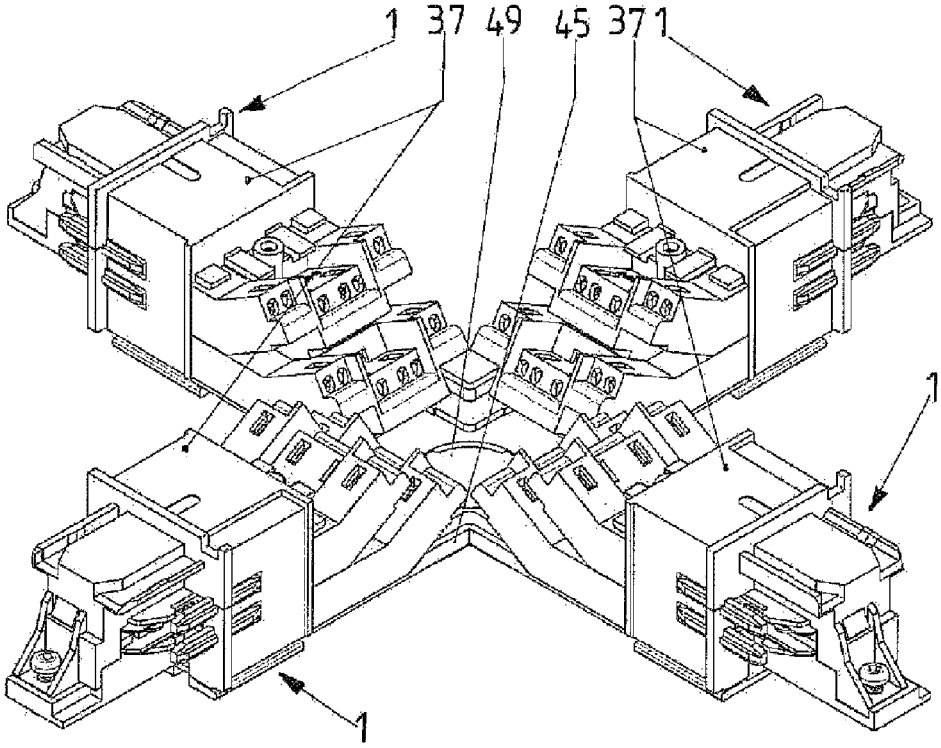
FIG. 19 is a view of another variant, seen as in FIG. 16.
Figure 20:
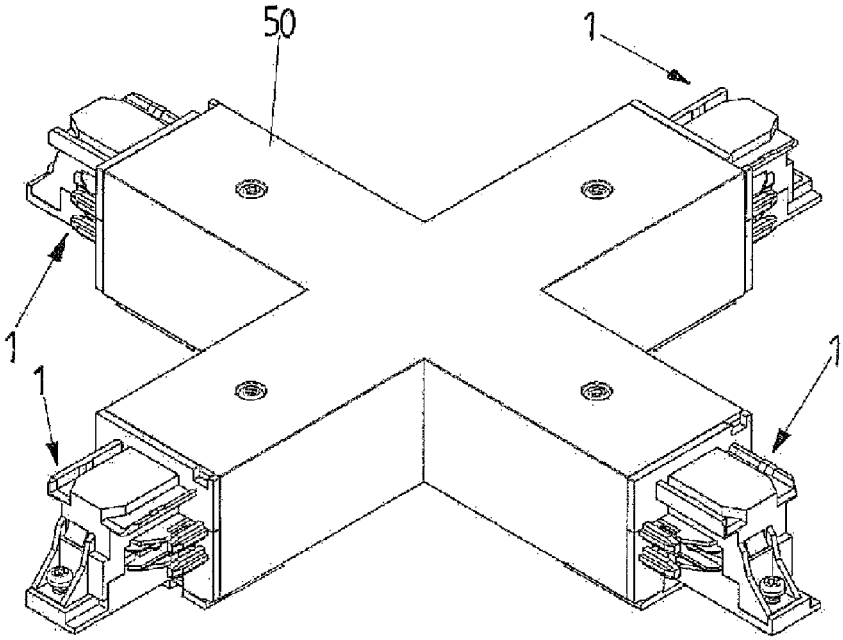
FIG. 20 shows the variant with a cover.

As FIG. 18 illustrates, the appropriate couplings may also be used to make up a T-shaped connecting piece or even a star-shaped connecting piece, as is shown in FIGS. 19 and 20. Both the modular structure of the coupling itself and the modular structure of the corresponding connectors is helpful for cost effective production and simple assembly, it being possible to use one and the same coupling 1 for different requirements. The appropriate design of the other components that can be placed on the coupling 1 and connected thereto is the same for all embodiments, it merely being necessary to provide different shapes of plates 45 and housing covers 50 in order to realize the corresponding design.

The invention is not limited to the illustrated embodiments, but rather may vary widely within the context of the disclosure.

All of the individual and combined features disclosed in the description and/or drawing are considered essential to the invention.

I claim:

1. An U-section power track having a floor and a pair of side walls defining a longitudinally and transversely open retaining channel and provided on the side walls with respective dielectric support rails each carrying a respective longitudinally extending main conductor transversely exposed in the slot and connected to phase or ground, the coupling comprising:

a dielectric coupling housing extending along an axis and having center structure defining a center plane perpendicular to the axis and end formations projecting axially oppositely from the center structure, each of the end formations being fittable longitudinally into the channel at an end of the power track to an insertion depth determined by the center structure, the housing being substantially symmetrical to the center plane;

two L-section and longitudinally extending metallic contact strips carried on and transversely limitedly movable in a predetermined transverse direction in the dielectric housing, the contact strips each having two L-legs of which one extends in the predetermined transverse direction and forms a pair of transversely projecting contacts longitudinally symmetrically flanking the center structure, the other L-leg of each contact strip extending substantially perpendicular to the predetermined transverse direction and juxtaposed with a respective guide face of the housing; and respective L-section sheet-metal guide elements fitted with the contact strips and each having one flat L-leg lying between the other L-leg of the respective contact strip and the respective guide face and another L-leg formed as a V-shaped spring having a pair of ends longitudinally symmetrically flanking the center plane, bearing in the predetermined transverse direction on the respective other L-leg, and biasing the respective contact strip and its contacts transversely outward.

2. The power track defined in claim 1, further comprising:

spring-loaded ground contacts on the housing symmetrically longitudinally flanking the plane and engageable directly with the metal power track.

3. The power track defined in claim 1, further comprising a power-feed connector comprising:

a connector housing fittable around one of the end formations;

respective sheet contact elements in the connector housing each having one end fitted with and engaging a respective one of the contact strips and an opposite end adapted to be fitted with a respective power-feed conductor, the connector housing being formed with respective sockets holding the opposite ends of the respective contact elements and opening at an acute angle to the axis; and a cover fittable over the connector housing for enclosing and protecting the sockets.

4. The power track defined in claim 3 wherein the connector housing has a dielectric part fittable with the end formation of the coupling housing and forming the sockets, and a metal plate carrying the dielectric plate and formed with a hole adapted for feeding in a power cable.

5. The power track defined in claim 3 wherein the connector housing is adapted to fit with a plurality of the end formations and has respective pluralities of contact elements and sockets.

6. The power track defined in claim 1, wherein there are two such conductors on each of the dielectric support rails and two such contact strips, two such guide faces, and two such respective guide elements on each of two transversely opposite side of the housing.

7. The power track defined in claim 6, further comprising:

a third secondary conductor on each dielectric support rail between the respective main conductors; and respective third secondary contacts on the housing engageable with the respective third secondary conductors1.

8. The power track defined in claim 6 wherein the housing extends between each contact strip and the respective guide element and the other contact strips and guide elements so as to insulate same from each other.

9. The power track defined in claim 8 wherein the housing has two parts each forming two of the guide faces and holding the respective two contact strips and guide elements and snap formations securing the two parts together.

* * * * *